US009939757B2

(12) United States Patent
Kanno

(10) Patent No.: US 9,939,757 B2
(45) Date of Patent: Apr. 10, 2018

(54) IMAGE FORMING APPARATUS INCLUDING A CONTACT-SEPARATION MECHANISM

(71) Applicant: CANON KABUSHIKI KAISHA, Tokyo (JP)

(72) Inventor: Naoki Kanno, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/049,779

(22) Filed: Feb. 22, 2016

(65) Prior Publication Data

US 2016/0252843 A1 Sep. 1, 2016

(30) Foreign Application Priority Data

Feb. 27, 2015 (JP) ..... 2015-039422

(51) Int. Cl.

| | |
|---|---|
| ***G03G 15/08*** | (2006.01) |
| ***G03G 21/18*** | (2006.01) |
| ***G03G 15/01*** | (2006.01) |

(52) U.S. Cl.

CPC ..... *G03G 15/0822* (2013.01); *G03G 15/0121* (2013.01); *G03G 15/0189* (2013.01); *G03G 21/1825* (2013.01)

(58) Field of Classification Search

CPC ..... G03G 2215/018

See application file for complete search history.

(56) References Cited

U.S. PATENT DOCUMENTS

2003/0038955 A1* 2/2003 Yamada ..... G03G 15/01 358/1.9
2010/0124427 A1* 5/2010 Sugiyama ..... G03G 15/0813 399/53

FOREIGN PATENT DOCUMENTS

| | | | | |
|---|---|---|---|---|
| JP | 2006-171359 | A | | 6/2006 |
| JP | 2006-171541 | A | | 6/2006 |
| JP | 2006171359 | A | * | 6/2006 |
| JP | 2007-213024 | A | | 8/2007 |
| JP | 2010-262180 | A | | 11/2010 |
| JP | 2011-123441 | A | | 6/2011 |
| JP | 2013-130662 | A | | 7/2013 |

OTHER PUBLICATIONS

JP_2006171359_A_T MachineTranslation, Japan, Okubo, 2006.*

* cited by examiner

*Primary Examiner* — Victor Verbitsky
(74) *Attorney, Agent, or Firm* — Canon USA, Inc. I.P. Division

(57) ABSTRACT

A plurality of development units includes at least a first development unit and a second development unit, and a plurality of photosensitive members includes at least a first photosensitive member corresponding to the first development unit and a second photosensitive member corresponding to the second development unit. After shifting the first development unit and the first photosensitive member into a contact state and shifting the second development state and the second photosensitive member into a contact state, a control unit controls a timing at which the first development unit develops an electrostatic latent image, based on a contact timing at which the second development unit and the second photosensitive member are shifted into a contact state.

19 Claims, 12 Drawing Sheets

IMAGE FORMING APPARATUS INCLUDING A CONTACT-SEPARATION MECHANISM

BACKGROUND OF THE INVENTION

Field of the Invention

The present invention relates to an image forming apparatus employing an electro-photographic system.

Description of the Related Art

As an image forming apparatus employing an electro-photographic system, there has been known a so-called inline-system image forming apparatus that sequentially forms images through a plurality of image forming units (hereinafter, also referred to as "stations") corresponding to respective colors of yellow (Y), magenta (M), cyan (C), and black (K). A contact development system is widely employed in such an inline-system image forming apparatus. In the contact development system, development is executed in a state in which a development roller serving as a development unit is in contact with a photosensitive drum.

For example, as described in Japanese Patent Application Laid-Open No. 2007-213024, the contact development system image forming apparatus includes a contact-separation mechanism. The contact-separation mechanism brings a photosensitive drum and a development roller into contact with each other when image formation is executed, and separates the photosensitive drum and the development roller from each other when the image formation is not executed. The contact-separation mechanism can switch between three states, i.e., a full-color contact state, a monochrome contact state, and a fully-separated state. In the full-color contact state, development rollers and respective photosensitive drums of stations of all colors are brought into contact with each other. In the monochrome contact state, for example, a development roller and a photosensitive drum of a black station are brought into contact with each other. In the fully-separated state, the development rollers and the respective photosensitive drums of the stations of all the colors are separated from each other.

The three states are switched by the following methods. One method is a method of sequentially switching the following states (1) to (3) (hereinafter, also referred to as "all-state shift type"): (1) Shift from the fully-separated state to the full-color contact state; (2) Shift from the full-color contact state to the monochrome contact state; and (3) Shift from the monochrome contact state to the fully-separated state. In addition, another method is a method of selectively switching the following states (4) and (5) (hereinafter, also referred to as "independent shift type"): (4) Shift from the fully-separated state to the full-color contact state and shift from the full-color contact state to the fully-separated state; and (5) Shift from the fully-separated state to the monochrome contact state and shift from the monochrome contact state to the fully-separated state. In such a contact development-system image forming apparatus, when a full-color image is to be formed, image formation is started after the contact-separation mechanism shifts a state to the full-color state. Further, when a monochrome image is to be formed, image formation is started after the contact-separation mechanism shifts the state to the full-color contact state or the monochrome contact state.

In the contact development-system image forming apparatus, image formation is executed while switching the development rollers and the respective photosensitive drums of the stations of respective colors to the contact state or the separated state. In the above-described system, as described in the conventional technique, image formation may be executed by stations of a part of the colors instead of stations of all the colors. In such a case, there is a problem of image quality degradation. More specifically, switching a station of one color that does not execute image formation between the contact state and the separated state degrades the quality of an image formed by a station of another color.

SUMMARY OF THE INVENTION

According to an aspect of the present invention, an image forming apparatus includes a plurality of photosensitive members, a plurality of development units respectively corresponding to the plurality of photosensitive members, and configured to develop electrostatic latent images formed on the plurality of photosensitive members as toner images, an image bearing member onto which the plurality of toner images developed by the plurality of development units are transferred, a shifting unit configured to shift between a contact state in which the plurality of photosensitive members and the plurality of development units are in contact with each other and a separated state in which the plurality of photosensitive members and the plurality of development units are separated from each other; and a control unit configured to control whether to shift the plurality of photosensitive members and the plurality of development units into the contact state or the separated state, wherein the plurality of development units includes at least a first development unit and a second development unit, and the plurality of photosensitive members includes at least a first photosensitive member corresponding to the first development unit and a second photosensitive member corresponding to the second development unit, and wherein, after shifting the first development unit and the first photosensitive member into a contact state and shifting the second development unit and the second photosensitive member into a contact state, the control unit controls a timing at which the first development unit develops an electrostatic latent image, based on a contact timing at which the second development unit and the second photosensitive member are shifted into a contact state.

Further features of the present invention will become apparent from the following description of exemplary embodiments with reference to the attached drawings.

DESCRIPTION OF THE EMBODIMENTS

Hereinafter, exemplary embodiments of the present invention will be described with reference to the appended drawings. The following exemplary embodiments are not intended to limit the scope of the invention set forth in the appended claims, and not all combinations of the features described in the following exemplary embodiments are essential to the technical solution provided by the present invention.

[Description of Image Forming Apparatus]

Figure 1:
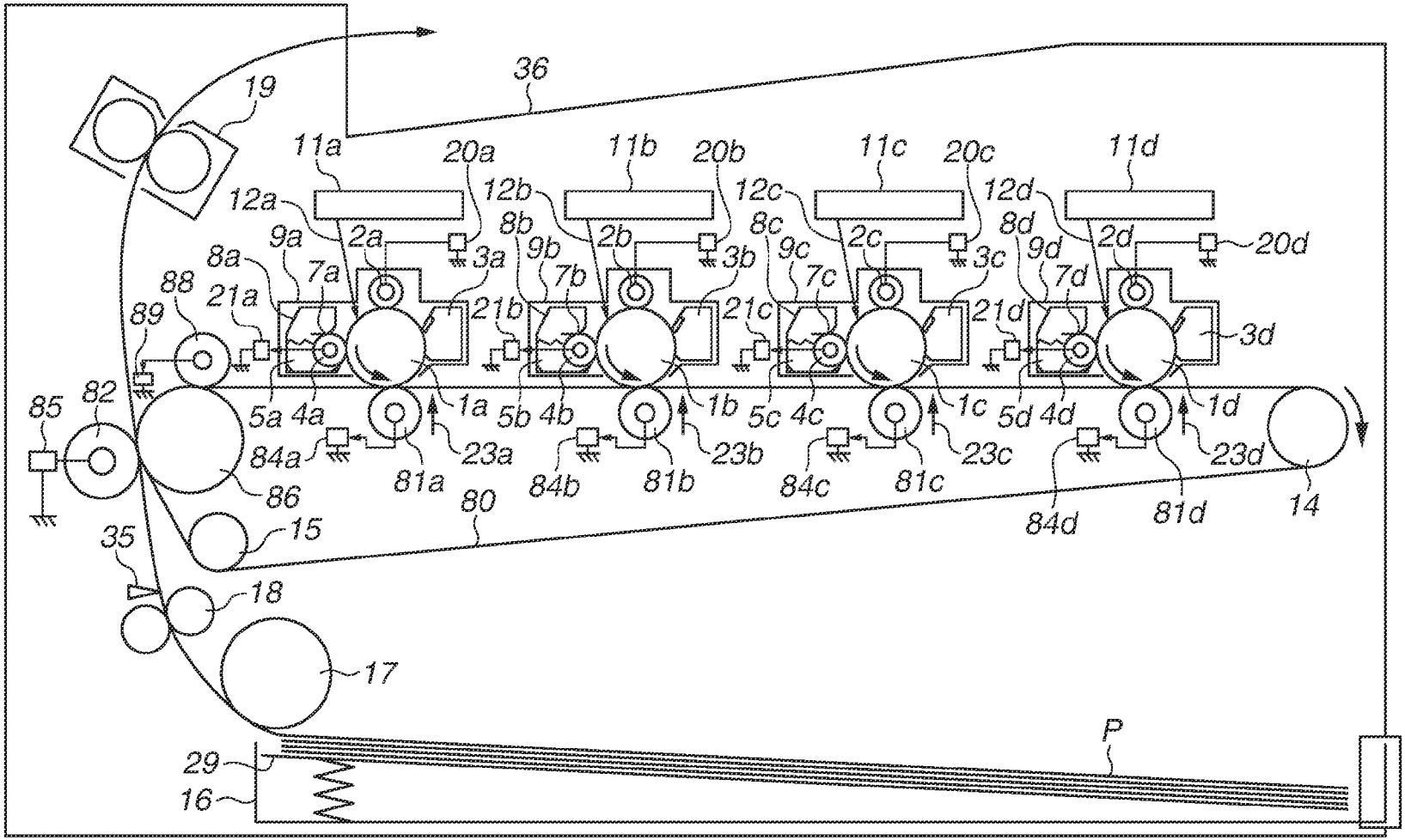
FIG. 1 is a diagram schematically illustrating a configuration of an image forming apparatus.

FIG. 1 is a diagram schematically illustrating a configuration of an image forming apparatus according to a first exemplary embodiment. In the following description, alphabets "a", "b", "c", and "d" at the trailing ends of reference numerals indicate that the corresponding members are related to the formation of the respective toner images of yellow (Y), magenta (M), cyan (C), and black (Bk). In the following description, if it is not necessary to distinguish between colors, a reference numeral without the alphabet "a", "b", "c", or "d" at the trailing end may be used.

(Image Forming Unit)

First, an image forming unit (hereinafter, also referred to as "station") for forming a yellow (Y) toner image will be described. A photosensitive drum 1*a* serving as a photosensitive member includes multilayered functional organic materials stacked on a metallic cylinder. The functional organic materials include a carrier generation layer that is exposed to light to generate electric charge, and an electric charge transportation layer that transports the generated electric charge. The outermost layer of the photosensitive drum 1*a* is approximately insulated and electrical conductivity thereof is low. A charging roller 2*a* serving as a charging unit contacts the photosensitive drum 1*a* and uniformly charges the surface of the photosensitive drum 1*a* while being rotationally driven according to the rotation of the photosensitive drum 1*a*. Direct-current voltage or superimposed voltage of alternate-current voltage is applied to the charging roller 2*a*, so that the photosensitive drum 1*a* is charged by electric discharge generated in minute air gaps on the upstream and the downstream sides of a contact nip portion between the surfaces of the charging roller 2*a* and the photosensitive drum 1*a*.

A scanner unit 11*a* serving as a light irradiation unit is configured to execute laser light scanning through a polygon mirror, or to execute light irradiation through a light-emitting diode (LED) array. The scanner unit 11*a* forms an electrostatic latent image by irradiating the surface of the photosensitive drum 1*a* (a photosensitive member) with a beam 12*a* modulated based on an image signal. A development unit 8*a* serving as a development unit includes a development roller 4*a*, nonmagnetic mono-component developer 5*a*, and a developer application blade 7*a*. The development roller 4*a* contacts the photosensitive drum 1*a*. An electrostatic latent image formed on the photosensitive drum 1*a* is developed as a toner image (developer image) by the development roller 4*a*. A primary transfer bias is applied to a primary transfer roller 81*a*, so that the developed toner image is primarily transferred onto an intermediate transfer belt 80 serving as an image bearing member. After the primary transfer, transfer residual toner remaining on the photosensitive drum 1*a* is cleaned by a cleaning unit 3*a*.

Further, the charging roller 2*a* is connected to a charging bias power source 20*a* serving as a unit for supplying voltage to the charging roller 2*a*, and the power is thereby supplied thereto. The development roller 4*a* is connected to a development bias power source 21*a* serving as a unit for supplying voltage to the development roller 4*a*, and the power is thereby supplied thereto. The primary transfer roller 81*a* is connected to a primary transfer bias power source 84*a* serving as a unit for supplying voltage to the primary transfer roller 81*a*, and the power is thereby supplied thereto. In addition, the above-described photosensitive drum 1*a*, the charging roller 2*a*, the cleaning unit 3*a*, the development roller 4*a*, the nonmagnetic mono-component developer 5*a*, the developer application blade 7*a*, and the development unit 8*a* can be integrated into a process cartridge 9*a* that is detachably attached to the image forming apparatus. However, a configuration of the cartridge is not limited to the above. The photosensitive drum 1*a* may be configured as one cartridge, and the development unit 8*a* and the like may be separately configured as a development cartridge.

A configuration of the station corresponding to the yellow color has been described above, and the same configuration is applicable to the stations corresponding to respective colors of magenta, cyan, and black. Each unit is assigned the same reference numeral with an alphabet "b", "c", or "d" at the trailing end thereof, and the detailed description will be omitted. Hereinafter, a station for forming a yellow (Y) toner image is also referred to as a first station. Similarly, a station for forming a magenta (M) toner image is referred to as a second station, a station for forming a cyan (C) toner image is referred to as a third station, and a station for forming a black (K) toner image is referred to as a fourth station. The first station is disposed on the most upstream side in a moving direction of the intermediate transfer belt 80, and the second, the third, and the fourth stations are disposed in this order from the most upstream side.

Although the detailed description has been omitted in the above description, each of the units can be read as follows. In other words, the photosensitive drum 1*a* can be read as the photosensitive drum 1*b*, 1*c*, or 1*d*. The charging roller 2*a* can be read as the charging roller 2*b*, 2*c*, or 2*d*. The cleaning unit 3*a* can be read as the cleaning unit 3*b*, 3*c*, or 3*d*. The development roller 4*a* can be read as the development roller 4*b*, 4*c*, or 4*d*. The nonmagnetic mono-component developer 5*a* can be read as the nonmagnetic mono-component developer 5*b*, 5*c*, or 5*d*. The developer application blade 7*a* can be read as the developer application blade 7*b*, 7*c*, or 7*d*. The development unit 8*a* can be read as the development unit 8*b*, 8*c*, or 8*d*. The process cartridge 9*a* can be read as the process cartridge 9*b*, 9*c*, or 9*d*. The scanner unit 11*a* can be read as the scanner unit 11*b*, 11*c*, or 11*d*. The beam 12*a* can be read as the beam 12*b*, 12*c*, or 12*d*. The charging bias power source 20*a* can be read as the charging bias power source 20*b*, 20*c*, or 20*d*. The development bias power source 21*a* can be read as the development bias power source 21*b*, 21*c*, or 21*d*. The primary transfer roller 81*a* can be read as the primary transfer roller 81*b*, 81*c*, or 81*d*.

The intermediate transfer belt 80 is supported by three rollers, i.e., a secondary transfer counter roller 86, a driving roller 14, and a tension roller 15 that serve as stretching members, and appropriate tension can be thereby maintained. By driving the driving roller 14, the intermediate transfer belt 80 is rotated and moved at substantially constant speed in a forward direction with respect to the photosensitive drums 1*a*, 1*b*, 1*c*, and 1*d*. Further, the primary transfer rollers 81*a*, 81*b*, 81*c*, and 81*d* that contact the intermediate transfer belt 80 are disposed on the inner side of the intermediate transfer belt 80, so as to face the respective photosensitive drums 1*a*, 1*b*, 1*c*, and 1*d*. The primary transfer rollers 81*a*, 81*b*, 81*c*, and 81*d* are respectively connected to the primary transfer bias power source 84*a*, 84*b*, 84*c*, and 84*d*. The toner images of the respective colors formed on the respective photosensitive drums 1*a*, 1*b*, 1*c*, and 1*d* are sequentially transferred onto the intermediate transfer belt 80 by the primary transfer rollers 81*a*, 81*b*, 81*c*, and 81*d*, so that a color image is formed. Further, static elimination members 23*a*, 23*b*, 23*c*, and 23*d* are disposed on the downstream sides of the respective primary transfer rollers 81*a*, 81*b*, 81*c*, and 81*d* in a rotation direction of the intermediate transfer belt 80. The driving roller 14, the tension roller 15, the static elimination members 23*a*, 23*b*, 23*c*, and 23*d*, and the secondary transfer counter roller 86 are electrically grounded.

When a recording material P such as a sheet is fed from a sheet feeding cassette 16, a pickup roller 17 is driven by a stepping motor (not illustrated) (hereinafter, also referred to as "sheet feeding motor"). A bottom plate 29 moves upward in accordance with the above operation, so that the recording materials P stacked in the sheet feeding cassette 16 are pushed up. The uppermost sheet of the pushed-up recording materials P contacts the pickup roller 17, so that the recording material P is fed according to the rotation of the pickup roller 17. When the fed recording material P is conveyed to a registration roller 18 and the leading end of the recording material P is detected by a registration sensor 35, the sheet feeding motor stops driving the pickup roller 17, so that conveyance of the recording material P is stopped temporarily. The recording material P temporarily stopped at the registration roller 18 is conveyed again at a predetermined timing in accordance with the movement of the toner image transferred to the intermediate transfer belt 80, so as to be conveyed to a secondary transfer portion.

A color image formed on the intermediate transfer belt 80 by transferring the toner images formed on the photosensitive drums 1*a* to 1*d* is conveyed to a secondary transfer position, i.e., the secondary transfer portion formed by a secondary transfer roller 82 and the intermediate transfer belt 80. Secondary transfer bias is applied to the secondary transfer roller 82, so that the color image on the intermediate transfer belt 80 is secondarily transferred onto the recording material P.

A fixing unit 19 including a heating member such as a fixing film and a pressure member such as a pressure roller applies heat and pressure to the color image secondarily transferred onto the recording material P, so that the color toner image is fixed onto the recording material P. The recording material P on which the toner image is fixed by the fixing unit 19 is discharged to a sheet discharge tray 36, so that a series of image forming operations is completed.

[Description of Development Contact-Separation Operation]

Figure 2:
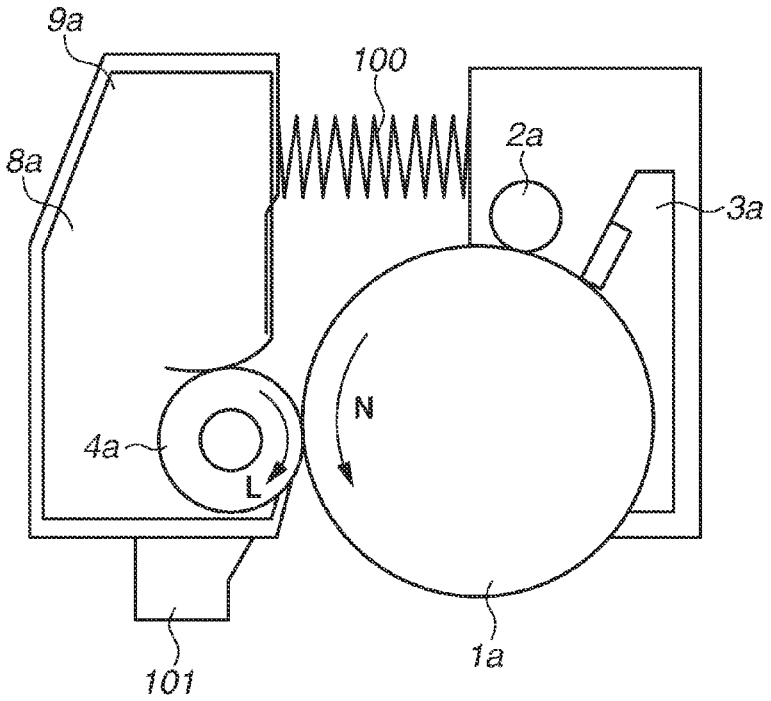
FIG. 2 is a cross-sectional view of a process cartridge.

FIG. 2 is a cross-sectional view of the process cartridge 9*a*. Because the configurations of process cartridges of respective colors are the same, the process cartridge 9*a* corresponding to yellow will be described.

By receiving driving force from a motor (not illustrated), the photosensitive drum 1*a* and the development roller 4*a* are rotationally driven in a counter-clockwise (an arrow N direction) and a clockwise direction (an arrow L direction), respectively, at respective predetermined speeds. The development unit 8*a* is urged by a pressure spring 100 serving as an elastic member, and enters a contact state in which the development roller 4*a* contacts the photosensitive drum 1*a*, with a rotation center of the photosensitive drum 1*a* serving as a rotation axis. Further, a shaft bearing member 101 is disposed at an end portion of the development unit 8*a* in an axis line direction (i.e., lengthwise direction) of the development roller 4*a*. When a predetermined force is applied to the shaft bearing member 101, the development unit 8*a* enters a separated state in which the development roller 4*a* and the photosensitive drum 1*a* are separated from each other.

Figure 3A:
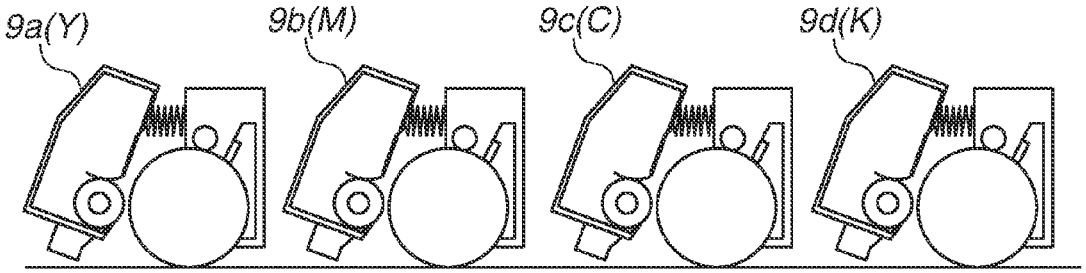
FIGS. 3A, 3B, and 3C are diagrams illustrating a contact state and a separated state of photosensitive drums and development rollers.
Figure 3B:
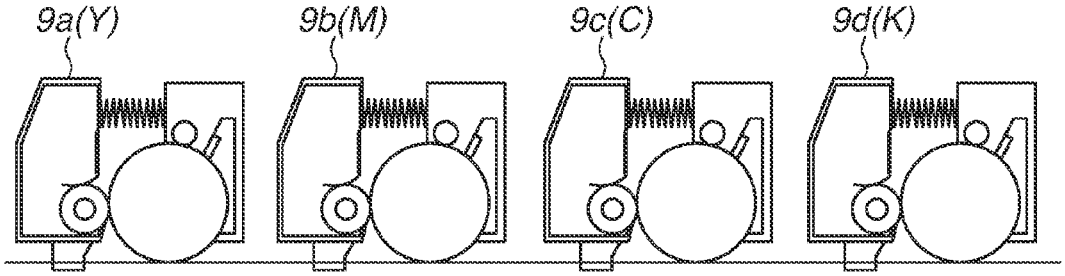
Figure 3C:
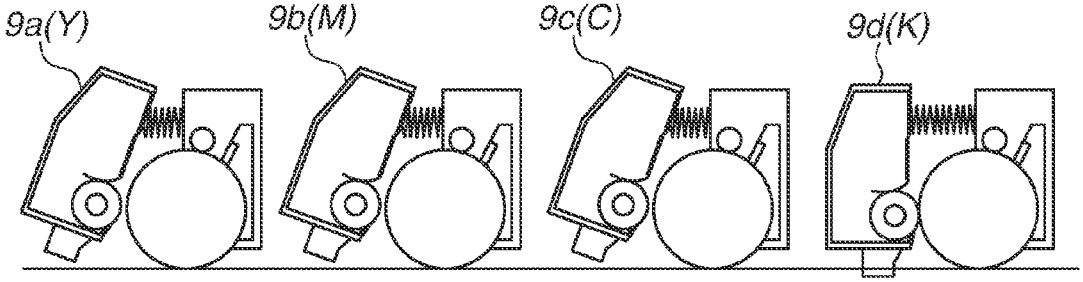

FIGS. 3A to 3C are diagrams illustrating a contact state and a separated state of the photosensitive drums 1 and the development rollers 4. In FIG. 3A to 3C, as an example, a state is shifted as follows by mechanical structures such as a cam (not illustrated) or the configuration of each actuator: (1) Shift from the fully-separated state to the full-color contact state; (2) Shift from the full-color contact state to the monochrome contact state; and (3) Shift from the monochrome contact state to the fully-separated state. A method for sequentially switching the above states (1) to (3) (i.e., all-state shift type) will be described.

FIG. 3A is a diagram illustrating a fully-separated state. When image formation is not executed, force is applied to the shaft bearing members 101 of stations of respective colors by cams (not illustrated) to enter the fully-separated state in which the photosensitive drums 1 and the development rollers 4 of the respective colors are separated from each other. If the photosensitive drums 1 and the development rollers 4 are unnecessarily brought into contact with each other, the lifetime thereof may be shortened. Furthermore, if the photosensitive drums 1 and the development rollers 4 are stopped and not driven for a long time in a contact state, contact streaks may be formed on the photosensitive drums 1. In order to prevent the above-described problems, the photosensitive drums 1 and the development rollers 4 are brought into a fully-separated state.

FIG. 3B is a diagram illustrating a full-color contact state. When the force applied to the shaft bearing members 101 of the stations of the respective colors is released, the fully-separated state illustrated in FIG. 3A is shifted to the full-color contact state in which the photosensitive drums 1 and the development rollers 4 of the stations of the respective colors are in contact with each other. The switching of the state from the state in FIG. 3A to the state in FIG. 3B is a switching operation corresponding to (1) Shift from the fully-separated state to the full-color contact state.

FIG. 3C is a diagram illustrating a monochrome contact state. When the force is applied to the shaft bearing members 101 of the yellow, magenta, and cyan stations by the cams (not illustrated), and the development rollers 4 of the yellow, magenta, and cyan stations are thereby separated from the photosensitive drums 1, the full-color contact state illustrated in FIG. 3B is shifted to the monochrome contact state. The switching of the state from the state in FIG. 3B to the state in FIG. 3C is a switching operation corresponding to (2) Shift from the full-color contact state to the monochrome contact state. Further, the switching of the state from the state in FIG. 3C to the state in FIG. 3A is a switching operation corresponding to (3) Shift from the monochrome contact state to the fully-separated state. As described above, the all-state shift type contact-separation switching operation is performed by sequentially shifting the states in FIGS. 3A to 3C.

The all-state shift type contact-separation switching operation has been described as an example. However, the switching operation may be executed by the following method: (4) Shift from the fully-separated state to the full-color contact state and shift from the full-color contact state to the fully-separated state; and (5) Shift from the fully-separated state to the monochrome contact state and shift from the monochrome contact state to the fully-separated state. Then, the above-described states (4) and (5) are selectively switched (hereinafter, also referred to as "independent shift type"). In FIGS. 3A to 3C, the switching of the state from the state in FIG. 3A to the state in FIG. 3B and from the state in FIG. 3B to the state in FIG. 3A is a switching operation corresponding to (4) Shift from the fully-separated state to the full-color contact state and shift from the full-color contact state to the fully-separated state. Further, the switching of the state from the state in FIG. 3A to the state in FIG. 3C and from the state in FIG. 3C to the state in FIG. 3A is a switching operation corresponding to (5) Shift from the fully-separated state to the monochrome contact state and from the monochrome contact state to the fully-separated state.

[System Configuration of Image Forming Apparatus]

Figure 4:
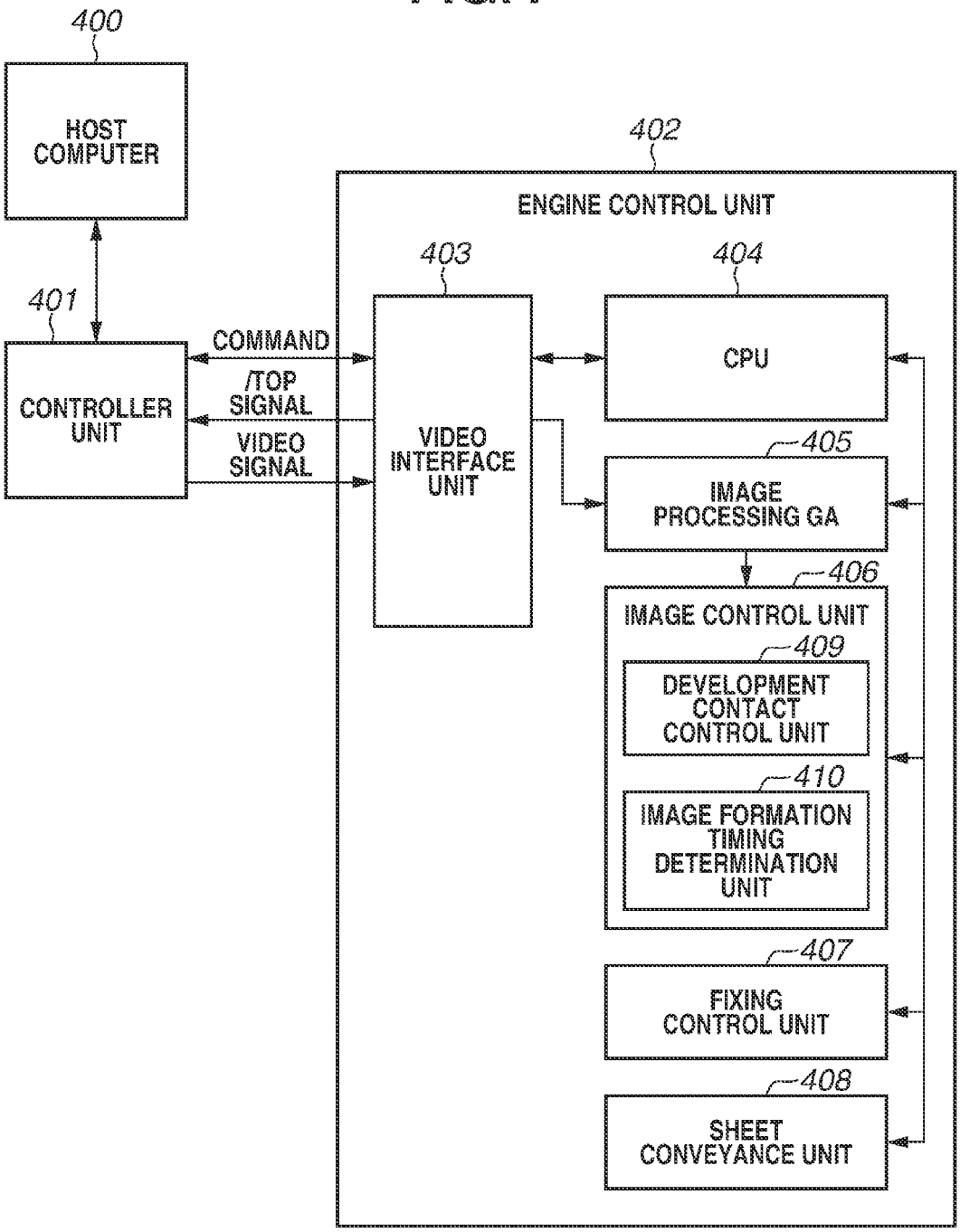
FIG. 4 is a block diagram illustrating a system configuration of the image forming apparatus.

FIG. 4 is a block diagram for illustrating a system configuration of the image forming apparatus. A controller unit 401 can mutually communicate with a host computer 400 and an engine control unit 402. The controller unit 401 receives image information and print instructions from the host computer 400, and analyzes the received image information to convert the image information into bit data as image data. Then, the controller unit 401 transmits a print color mode designation command, a vertical synchronizing signal reference color designation command, a print reservation command, a print start command, and a video signal to a central processing unit (CPU) 404 and an image processing GA 405 via a video interface unit 403 for each recording material. The vertical synchronizing signal reference color designation command is also referred to as a /TOP signal reference color designation command. As a more specific timing, in response to receiving the print instruction from the host computer 400, the controller unit 401 transmits the print color mode designation command, the /TOP signal reference color designation command, and the print reservation command to the CPU 404. Then, the controller unit 401 transmits the print start command to the CPU 404 at a timing at which the image forming apparatus becomes ready to execute printing, according to a preparation operation thereof.

The CPU 404 executes a preparation operation for executing printing, according to the content of the print color mode designation command, the /TOP signal reference color designation command, and the print reservation command received from the controller unit 401. Then, the CPU 404 waits until the print start command transmitted from the controller unit 401 is received. When the print start command is received, the CPU 404 instructs control units such as an image control unit 406, a fixing control unit 407, and a sheet conveyance unit 408 to start printing operations.

After receiving the instruction for starting the printing operation, as a preparation operation, the image control unit 406 determines a color mode based on the content of the print color mode designation command received from the controller unit 401. Then, the image control unit 406 instructs a development contact control unit 409 to switch the development contact states of the stations of the respective colors according to the designated color mode. According to the development contact state, an image formation timing determination unit 410 of the image control unit 406 determines an image formation timing as a timing for starting the image formation. A specific calculation method for determining the image formation timing will be described below.

The image control unit 406 determines whether the above-determined image formation timing has come. Then, when the CPU 404 is informed by the image control unit 406 that the image formation timing has come, the CPU 404 transmits, to the controller unit 401, a /TOP signal serving as a reference timing for outputting a video signal as image data. In other words, the /TOP signal serves as a request signal for the engine control unit 402 requesting image data from the controller unit 401.

When the controller unit 401 receives the /TOP signal from the CPU 404, the controller unit 401 outputs a video signal of a color designated by the /TOP signal reference color designation command, based on the /TOP signal. When the image processing GA 405 receives the video signal from the controller unit 401, the image processing GA 405 transmits image formation data to the image control unit 406. Based on the image formation data received from the image processing GA 405, the image control unit 406 executes image formation. When the sheet conveyance unit 408 receives an instruction for starting the printing operation, the sheet conveyance unit 408 starts sheet feeding and conveying operations. When the fixing control unit 407 receives the instruction for starting the printing operation, the fixing control unit 407 starts a fixing preparation. In accordance with a timing at which a recording material P on which secondary transfer processing is executed is conveyed to the fixing unit 19, the fixing control unit 407 starts temperature adjustment of the fixing unit 19 and fixes the toner image on the recording material P, according to the information indicated by the print reservation command.

[Description of /TOP Mode]

Figures 5A, 5B:
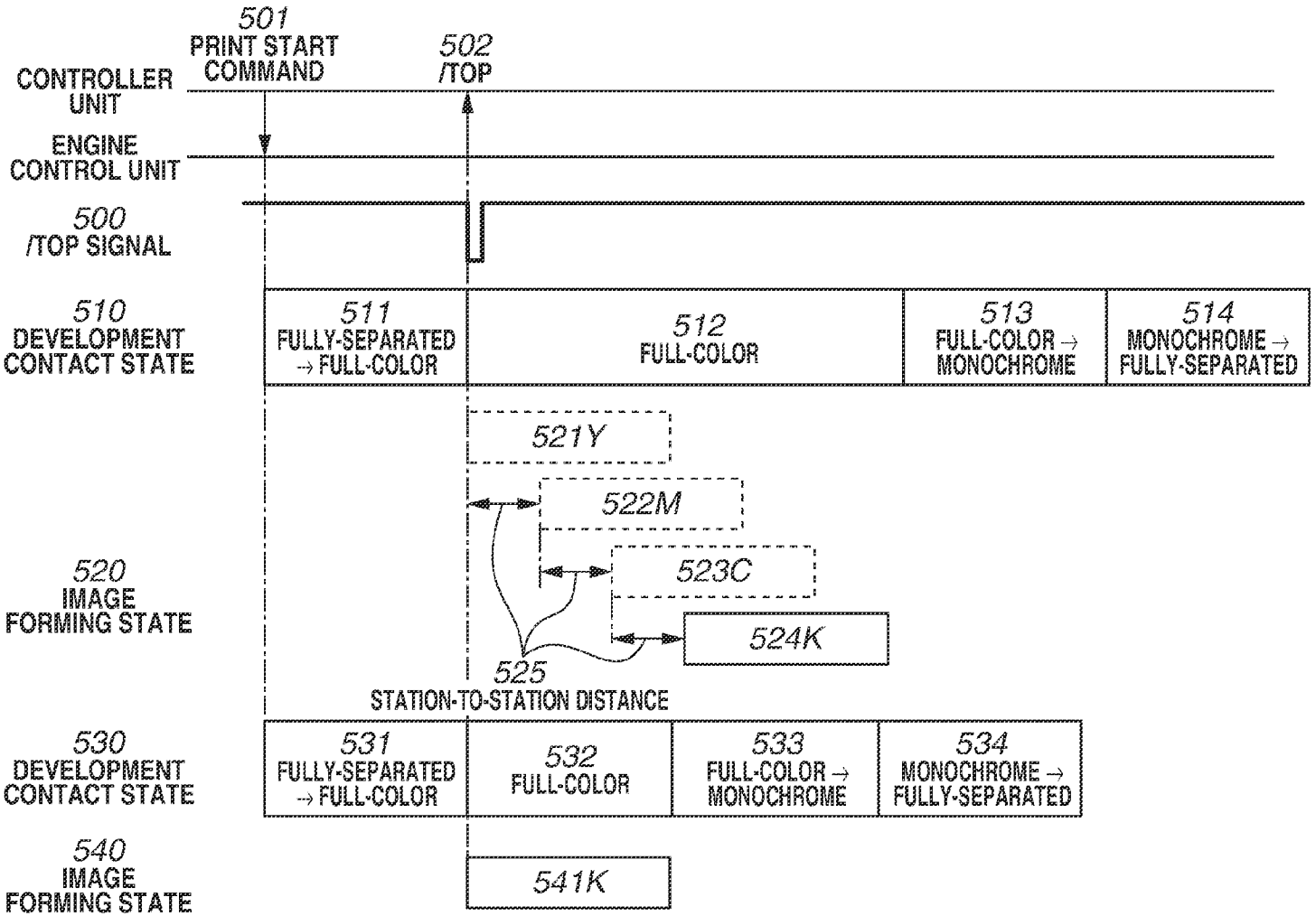
FIGS. 5A and 5B are timing charts illustrating an image formation timing based on a /TOP signal.

Next, an image formation timing that is based on the /TOP signal will be described with reference to FIGS. 5A and 5B. FIG. 5A illustrates a case where a full-color mode is designated by a print color mode designation command transmitted from the controller unit 401, and yellow is designated by the /TOP signal reference color designation command (hereinafter, also referred to as "YTOP mode"). FIG. 5A is a timing chart for forming a monochrome image in this case. Further, FIG. 5B illustrates a case where a full-color mode is designated by a print color mode designation command transmitted from the controller unit 401, and black is designated by the /TOP signal reference color designation command (hereinafter, also referred to as "KTOP mode"). FIG. 5B is a timing chart for forming a monochrome image in this case.

First, the YTOP mode will be described with reference to FIG. 5A. When the engine control unit 402 receives a print start command from the controller unit 401 (501), the engine control unit 402 shifts a development contact state from the fully-separated state to the full-color contact state (511) in order to form a monochrome image in the full-color mode. When the development contact state is shifted from the fully-separated state to the full-color contact state (512), the engine control unit 402 transmits a /TOP signal to the controller unit 401 (502).

When the controller unit 401 receives the /TOP signal from the engine control unit 402 (502), the controller unit 401 starts image formation using the yellow station (521), based on the reception of the /TOP signal. Further, based on the image formation start timing of the yellow station, the controller unit 401 waits until a time period corresponding to a station-to-station distance (525) of each color elapses. Then, when the time period corresponding to the station-to-station distance (525) of each color has elapsed, the controller unit 401 sequentially starts magenta image formation (522), cyan image formation (523), and black image formation (524). Thereafter, when the black image formation is completed, the engine control unit 402 shifts the development contact state from the full-color contact state (512) to the fully-separated state (514) via the monochrome contact state (513), and ends a series of image forming operations.

In addition, because monochrome image formation is executed in FIG. 5A, image data other than black is not transmitted (i.e., a so-called "blank state"), and thus image formations of yellow, magenta, and cyan are not executed. Therefore, in a case where a monochrome image is formed in the YTOP mode, a period from when the /TOP signal is received to when the black image formation is started is a period in which image formation is not executed.

Next, the KTOP mode will be described with reference to FIG. 5B. When the engine control unit 402 receives a print start command from the controller unit 401 (501), the engine control unit 402 shifts a development contact state from the fully-separated state to the full-color contact state (531) in order to form a monochrome image in the full-color mode. Because the image formation can be executed as long as the development roller 4 of the black station contacts the photosensitive drum 1, the engine control unit 402 transmits a /TOP signal to the controller unit 401 (502) when the development contact state is shifted from the fully-separated state to the full-color contact state (532).

When the controller unit 401 receives the /TOP signal from the engine control unit 402 (502), the controller unit 401 starts image formation using the black station (541), based on the reception of the /TOP signal. When the black image formation is completed, the engine control unit 402 shifts the development contact state from the full-color contact state (532) to the fully-separated state (534) via the monochrome contact state (533), and ends a series of image forming operations.

In the KTOP mode, a time period until the black image formation is started is shorter than that in the YTOP mode illustrated in FIG. 5A. In the YTOP mode, until the black image formation is started after the /TOP signal is received, there is a stand-by time period corresponding to distances between the stations of Y, M, and C. On the other hand, in the KTOP mode, the black image formation can be started immediately after the /TOP signal is received. In order to shorten the first printout time of the image forming apparatus, it is very effective to form a monochrome image by introducing the KTOP mode.

In a case where the monochrome image formation is to be executed in the KTOP mode, quality of the black image may be degraded due to the development contact state. A problem that may occur due to the contact state will be described with reference to FIGS. 6A to 6C.

Figure 6A:
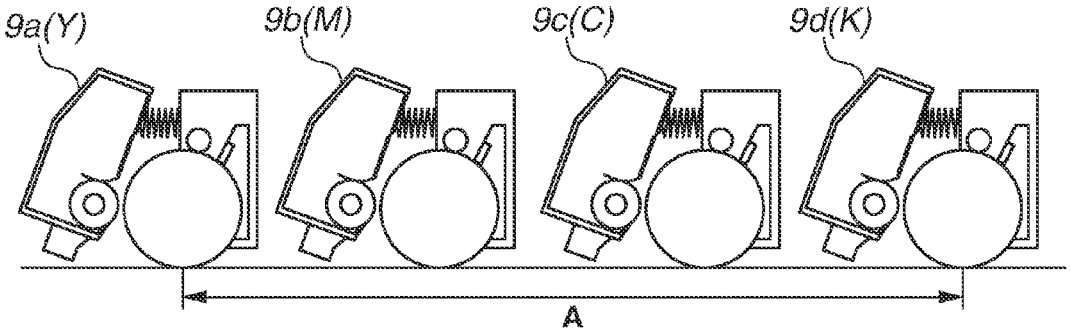
FIGS. 6A, 6B, and 6C are diagrams illustrating changes in contact states when image formation is executed in a KTOP mode.
Figure 6B:
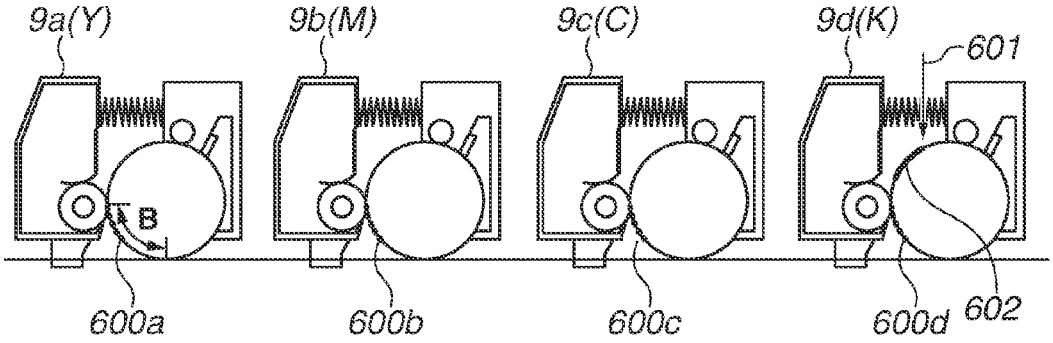
Figure 6C:
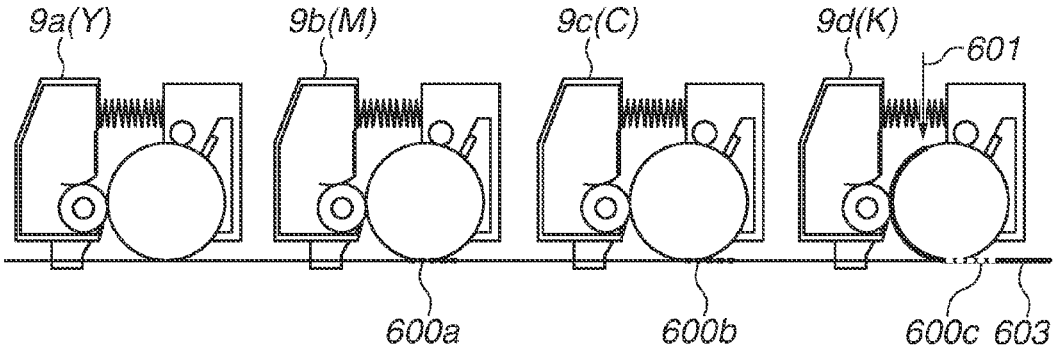

FIGS. 6A to 6C are diagrams illustrating changes in the contact states when the image formation is executed in the KTOP mode. In FIGS. 6A to 6C, a distance between primary transfer portions of a station of a /TOP signal reference color (here, a black station on the most downstream side) and a station on the most upstream side is A (mm), and a distance between a development contact position and a primary transfer portion of each station is B (mm).

FIG. 6A is a diagram illustrating a fully-separated state. When the engine control unit 402 receives a print start command from the controller unit 401, the engine control unit 402 shifts a development contact state to a full-color contact state illustrated in FIG. 6B. If the development rollers 4 contact the photosensitive drums 1 when the development contact state is shifted to the full-color contact state, contact streaks are generated at contact positions (i.e., portions indicated by dotted lines 600*a* to 600*d*) because of a circumferential speed difference in the rotational speeds of the development rollers 4 and the photosensitive drums 1. Thereafter, the engine control unit 402 transmits a /TOP signal, exposes the photosensitive drum 1 of the black station to light 601 according to image data received from the controller unit 401, and forms an electrostatic latent image 602.

FIG. 6C is a diagram illustrating a state in which an electrostatic latent image is developed as a toner image in the black station, and the toner image is primarily transferred onto the intermediate transfer belt 80. As illustrated in FIG. 6B, in the stations of the respective colors that are disposed on the upstream side of the black station, development contact streaks 600*a* to 600*c* are generated because of the contact between the development rollers 4 and the photosensitive drums 1. Thus, the development contact streaks 600*a* to 600*c* generated in the stations of the respective colors overlap with a black toner image 603 transferred onto the intermediate transfer belt 80, and images of colors that are not included in the original black toner image are superimposed, thereby causing an image quality degradation phenomenon. In the present exemplary embodiment, a method for controlling an image formation timing will be described below in detail. In the method, an image formation timing is controlled so as to suppress degradation in image quality that is caused by a development contact streak superimposed on an image formed through the monochrome image formation.

[Description of Control of Image Formation Start Timing]

Figure 7:
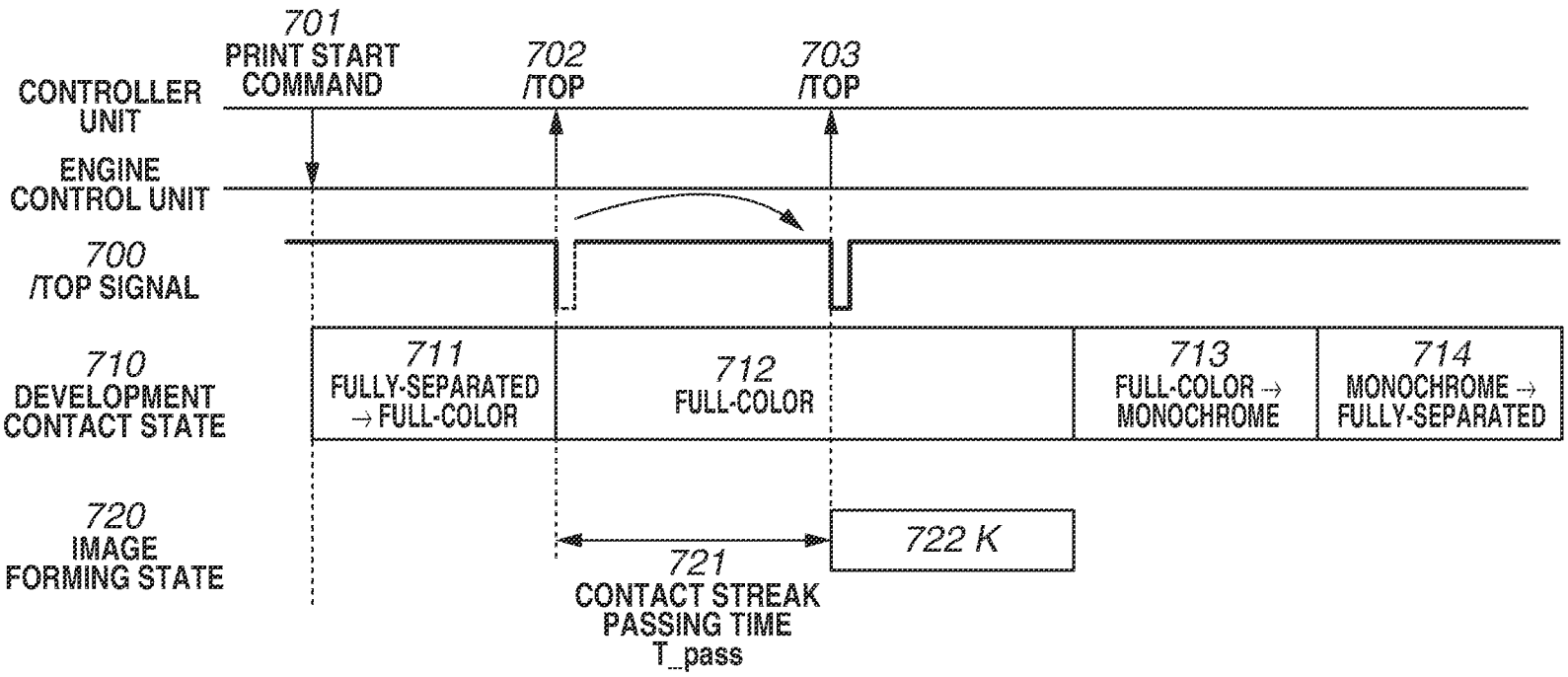
FIG. 7 is a timing chart illustrating control of an image formation start timing according to a first exemplary embodiment.

FIG. 7 is a timing chart illustrating control of an image formation start timing according to the present exemplary embodiment. When the engine control unit 402 receives a print start command from the controller unit 401 (701), the engine control unit 402 shifts a development contact state from the fully-separated state to the full-color contact state (711) in order to form a monochrome image in the full-color mode. The engine control unit 402 calculates a contact streak passing time T_pass (721), which is a time until a contact streak generated in the yellow station disposed on the most upstream side passes through the primary transfer portion of the black station. A specific calculation method for acquiring the contact streak passing time T_pass will be described below.

When the contact streak passing time T_pass has elapsed from a contact timing (702) at which the shift of the development contact state from the fully-separated state to the full-color contact state is completed, the engine control unit 402 transmits a /TOP signal to the controller unit 401 (703). In other words, the engine control unit 402 controls the /TOP signal to be transmitted so that the image is formed at a timing equal to or later than a timing at which the contact streak passes through the primary transfer portion. When the controller unit 401 receives the /TOP signal from the engine control unit 402 (703), the controller unit 401 starts image formation using the black station (722), based on the reception of the /TOP signal. When the black image formation is completed, the engine control unit 402 shifts the development contact state from the full-color contact state (712) to the fully-separated state (714) via the monochrome contact state (713), and ends a series of image forming operations.

The transmission of the /TOP signal from the engine control unit 402 to the controller unit 401 is controlled in this manner. In other words, a timing at which an electrostatic latent image is formed on the photosensitive drum 1 is controlled based on the /TOP signal. Further, in other words, a timing at which the development roller 4 develops the electrostatic latent image formed on the photosensitive drum 1 is controlled. By executing the above-described timing control, a contact streak can be prevented from being superimposed on the image.

Figure 8:
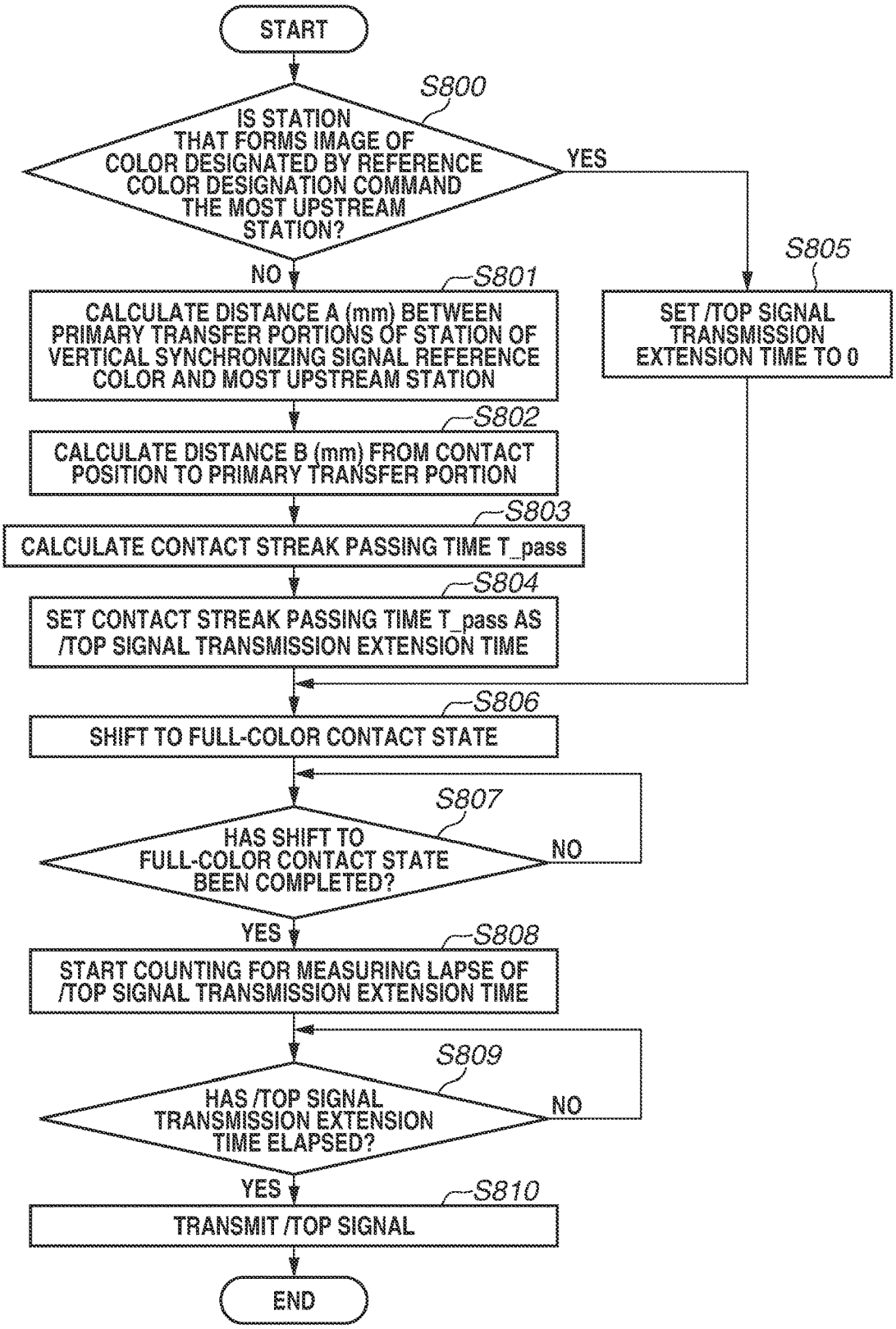
FIG. 8 is a flowchart illustrating control of an image formation start timing according to the first exemplary embodiment.

FIG. 8 is a flowchart illustrating control of an image formation start timing according to the present exemplary embodiment. In step S800, the engine control unit 402 receives a print instruction from the controller unit 401. Then, the engine control unit 402 determines whether the station that forms an image of a color designated by the /TOP signal reference color designation command transmitted from the controller unit 401 is a station disposed on the most upstream side. In the present exemplary embodiment, the most upstream station is the yellow station. Thus, in other words, the engine control unit 402 determines whether the image formation is executed in the YTOP mode. When it is determined in step S800 that the station is the most upstream station (YES in step S800), the processing proceeds to step S805. In step S805, the engine control unit 402 sets a /TOP signal transmission extension time to 0. On the other hand, when it is determined in step S800 that the station is not the most upstream station (NO in step S800), the processing proceeds to step S801. In the present exemplary embodiment, the processing in step S801 and subsequent steps will be described assuming that the most upstream station is the yellow station and the reference color of the /TOP signal is black, as an example.

In step S801, the engine control unit 402 calculates a distance A (mm) between primary transfer portions of a station of a reference color of the /TOP signal and the most upstream station. A distance between primary transfer portions of stations of respective colors is determined according to the configuration of the image forming apparatus, and can be prestored in a memory within the engine control unit 402. When a distance between primary transfer portions of adjacent stations is uniformly set to D (mm), and the number of stations disposed between the most upstream station and a station of a reference color of the /TOP signal is set to n (stations), the distance A (mm) between primary transfer portions of a station of a reference color of the /TOP signal and the most upstream station can be calculated to be $A=(n+1)\times D$ (mm).

In step S802, the engine control unit 402 calculates a distance B (mm) from a contact position of the development roller 4 and the photosensitive drum 1 to a primary transfer portion. A distance from a contact position of the development roller 4 and the photosensitive drum 1 of the station of each color to a primary transfer portion is determined according to the configuration of the image forming apparatus, and can be prestored in a memory within the engine control unit 402. In addition, when the contact streak has a certain width, the distance B (mm) can be obtained assuming a trailing end position of the contact streak as a contact position.

In step S803, the engine control unit 402 calculates the contact streak passing time T_pass. The contact streak passing time T_pass can be obtained by the following method. A sum of the distance A (mm) between primary transfer portions of a station of a reference color of the /TOP signal and the most upstream station that has been calculated in step S801 and the distance B (mm) from a development contact position to a primary transfer portion that has been calculated in step S802 is divided by a process speed S (mm/s). In step S804, the engine control unit 402 sets the contact streak passing time T_pass calculated in step S803 as the /TOP signal transmission extension time.

For example, parameters may be set as follows. The distance A between primary transfer portions of a station of a reference color of the /TOP signal and the most upstream station is set to 210 mm, the distance B from a development contact position to a primary transfer portion is set to 15 mm, and the process speed S is set to 100 mm/s. With the above parameters, the contact streak passing time T_pass can be obtained as T_pass=(210+15)/100=2.25 (s).

In step S806, the engine control unit 402 shifts the development contact state from the fully-separated state to the full-color contact state. In step S807, the engine control unit 402 determines whether the shift to the full-color contact state has been completed. When the shift to the full-color contact state has been completed (YES in step S807), the processing proceeds to step S808. In step S808, the engine control unit 402 starts counting for measuring the lapse of the /TOP signal transmission extension time calculated in step S804. In step S809, the engine control unit 402 determines whether the /TOP signal transmission extension time has elapsed.

In addition, when it is determined in step S800 that the station that forms an image of the color designated by the /TOP signal reference color designation command transmitted from the controller unit 401 is a station disposed on the most upstream side (YES in step S800), the processing proceeds to step S805. Then, in step S805, the /TOP signal transmission extension time is set to 0. In other words, the /TOP signal can be output without waiting for the lapse of the extension time because the stations are in such an arrangement relationship that contact streaks of respective colors will not be superimposed on the toner image to be formed. Therefore, the processing proceeds to step S810 without waiting for the lapse of the extension time in step S809.

When the engine control unit 402 determines in step S809 that the /TOP signal transmission extension time has elapsed (YES in step S809), the processing proceeds to step S810. In step S810, the engine control unit 402 transmits the /TOP signal to the controller unit 401. Thereafter, as described above, the image formation is started according to the /TOP signal.

By controlling the transmission timing of the /TOP signal in this manner, when the development contact state is shifted to the full-color contact state, it is possible to prevent the contact streak generated in the station that does not execute image formation, from being superimposed on the toner image formed by the station that executes image formation. Further, even in a case where a color other than a color of the most upstream station is designated as a reference color for transmitting the /TOP signal, the degradation in image quality can be suppressed by controlling the transmission timing of the /TOP signal. In other words, by controlling the transmission timing of the /TOP signal, the quality of an image formed by a station of one color can be prevented from being degraded due to the switching operation between the contact state and the separated state of the station of another color that does not execute image formation.

In addition, although a configuration of shifting a contact state through the all-state shift type switching operation has been described as an example in the present exemplary embodiment, a configuration is not limited thereto. Even in a case where the contact state is shifted through the independent shift type switching operation, a problem similar to the above-described problem may occur, and the same effects can be naturally achieved if a transmission timing of the /TOP signal is controlled as described in the present exemplary embodiment.

Further, although a transmission timing of the /TOP signal is determined based on a contact position of the most upstream station in the present exemplary embodiment, a configuration is not limited thereto. For example, in a case where the most upstream station is a yellow station, if the specification allows a contact streak generated in the yellow station to be superimposed on an image to be formed, a transmission timing of the /TOP signal can be determined based on a contact position of a station next to the most upstream station. Although a contact streak of the most upstream station is superimposed on the image to be formed, a transmission timing of the /TOP signal can be advanced by an amount of time corresponding to one station-to-station distance.

Further, although the description has been given of control processing for executing image formation after a contact streak generated in a station on the upstream side of a reference color station has passed a primary transfer portion of the reference color station, a configuration is not limited thereto. Even if the image formation is started before the contact streak passes the primary transfer portion of the reference color station, the contact streak can be prevented from being superimposed if the contact streak has passed the primary transfer portion of the reference color station before the leading end of the reference color image reaches the primary transfer portion of the reference color station. Furthermore, although the description has been given using a black color as an example of the reference color, the reference color is not limited thereto. Any color other than the color of the most upstream station may be designated as a reference color. In this case, a transmission timing of the /TOP signal is only required to be controlled in such a manner that a contact streak generated in the station on the upstream side of the reference color station is not superimposed on the reference color image.

In the first exemplary embodiment, the description has been given of the configuration of preventing a contact streak generated in a station that do not execute image formation from being superimposed on an image formed by a station that executes image formation, when a development contact state is shifted to the full-color state, by controlling a transmission timing of a /TOP signal. In a second exemplary embodiment, the description will be given of the configuration of preventing a separation shock blur generated in a station that does not execute image formation from affecting an image formed by a station that executes image formation, when the image formation is to be executed with the development contact state shifted to the monochrome contact state. In addition, the configuration of the image forming apparatus is similar to that described in the first exemplary embodiment, and thus the detailed description thereof will be omitted in the present exemplary embodiment.

[Description of /TOP Mode]

Figures 9A, 9B:
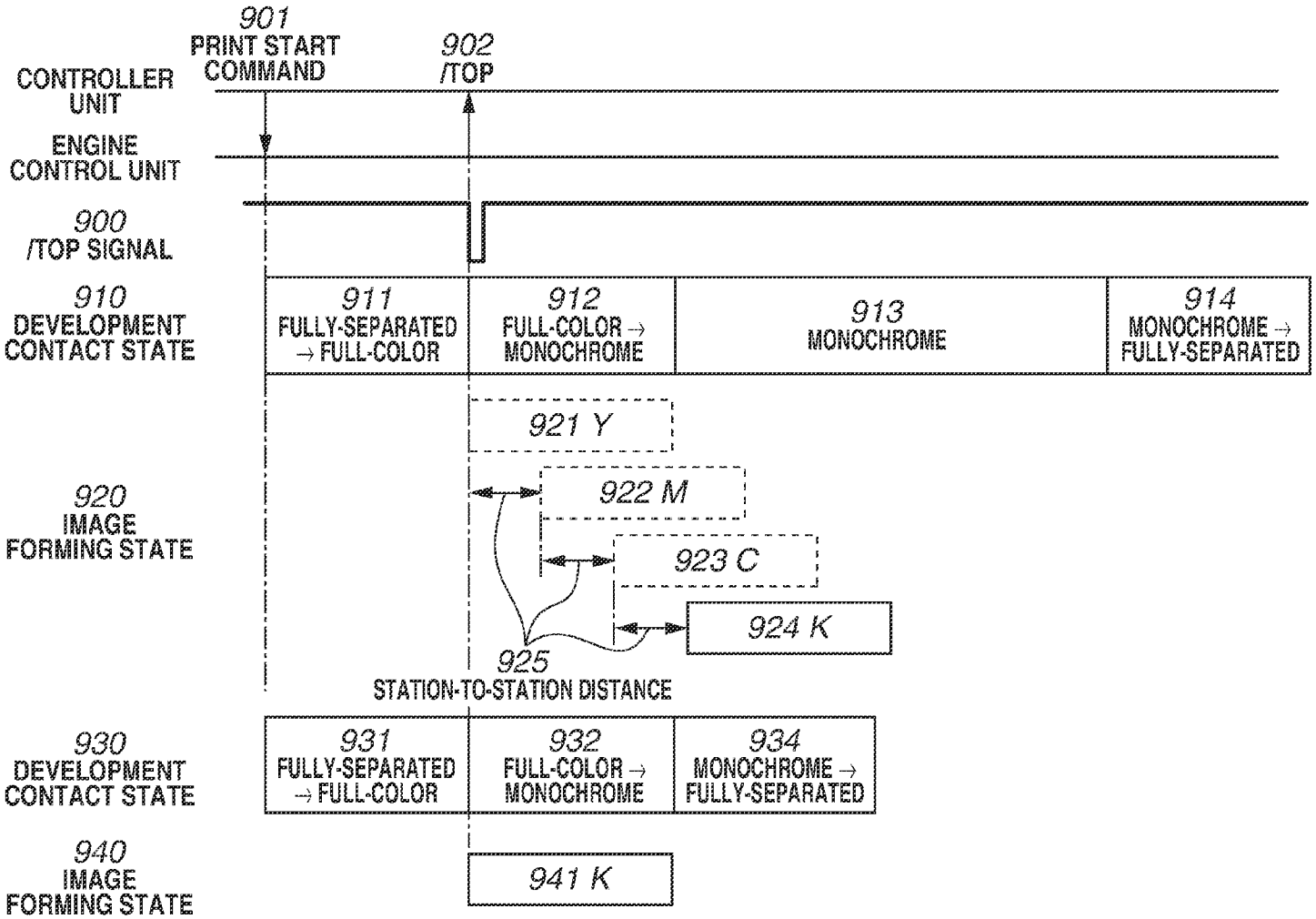
FIGS. 9A and 9B are timing charts illustrating an image formation timing based on a /TOP signal.

The image formation timing that is based on the /TOP signal will be described with reference to FIGS. 9A and 9B. FIG. 9A illustrates a case where a monochrome mode is designated by a print color mode designation command transmitted from the controller unit 401, and yellow is designated by the /TOP signal reference color designation command (hereinafter, also referred to as "YTOP mode"). FIG. 9A is a timing chart for forming a monochrome image in this case. Further, FIG. 9B illustrates a case where a monochrome mode is designated by a print color mode designation command transmitted from the controller unit 401, and black is designated by the /TOP signal reference color designation command (hereinafter, also referred to as "KTOP mode"). FIG. 9B is a timing chart for forming a monochrome image in this case.

First, the YTOP mode will be described with reference to FIG. 9A. The engine control unit 402 receives a print start command from the controller unit 401 (901). Then, in order to form a monochrome image in the monochrome mode, the engine control unit 402 shifts a development contact state from the fully-separated state to the monochrome contact state (912) via the full-color contact state (911). When the development contact state is shifted from the fully-separated state to the full-color contact state (911), the engine control unit 402 transmits a /TOP signal to the controller unit 401 (902). The image formation of a monochrome image is started under the condition that the development roller 4 of the black station contacts the photosensitive drum 1. In order to shorten the first print-out time, the engine control unit 402 transmits the /TOP signal to the controller unit 401 at a timing at which the development contact state is shifted to the full-color contact state.

The controller unit 401 receives the /TOP signal from the engine control unit 402 (902). Then, the controller unit 401 starts image formation using the yellow station (921), based on the reception of the /TOP signal. Further, based on the image formation start timing of the yellow station, the controller unit 401 waits until a time period corresponding to a station-to-station distance (925) of each color elapses. Then, when the time period corresponding to the station-to-station distance (925) of each color has elapsed, the controller unit 401 sequentially starts magenta image formation (922), cyan image formation (923), and black image formation (924). Thereafter, when the black image formation is completed, the engine control unit 402 shifts the development contact state from the monochrome contact state (913) to the fully-separated state (914), and ends a series of image forming operations.

In addition, because monochrome image formation is executed in FIG. 9A, image data other than black is not transmitted (i.e., a so-called "blank state"), and thus image formations of yellow, magenta, and cyan are not executed. Therefore, in a case where a monochrome image is formed in the YTOP mode, a period from when the /TOP signal is received to when the black image formation is started is a period in which image formation is not executed.

Next, the KTOP mode will be described with reference to FIG. 9B. The engine control unit 402 receives a print start command from the controller unit 401 (901). Then, in order to form a monochrome image in the monochrome mode, the engine control unit 402 shifts the development contact state from the fully-separated state to the monochrome contact state (932) via the full-color contact state (931). The image formation can be executed as long as the development roller 4 of the black station contacts the photosensitive drum 1. Thus, when the development contact state is shifted from the fully-separated state to the full-color contact state (931), the engine control unit 402 transmits a /TOP signal to the controller unit 401 (902).

When the controller unit 401 receives the /TOP signal from the engine control unit 402 (902), the controller unit 401 starts image formation using the black station (941), based on the reception of the /TOP signal. When the black image formation is completed, the engine control unit 402 shifts the development contact state from the monochrome contact state (932) to the fully-separated state (934), and ends a series of image forming operations.

In the KTOP mode, a time period before the black image formation is started is shorter than that in the YTOP mode illustrated in FIG. 9A. In the YTOP mode, until the black image formation is started after the /TOP signal is received, there is a stand-by time period corresponding to the distances between the stations of Y, M, and C. On the other hand, in the KTOP mode, the black image formation can be started immediately after the /TOP signal is received. In order to shorten the first printout time of the image forming apparatus, it is very effective to form a monochrome image by introducing the KTOP mode.

In a case where monochrome image formation is to be executed in the KTOP mode, quality of the black image may be degraded due to the development contact state. A problem that may occur due to the contact state will be described with reference to FIGS. 10A to 10C. In the following description, for the sake of simplicity, it is assumed that a contact streak generated in the first present exemplary embodiment is not generated or image quality is less influenced by the contact streak, and thus control for the contact streak will be omitted.

Figure 10A:
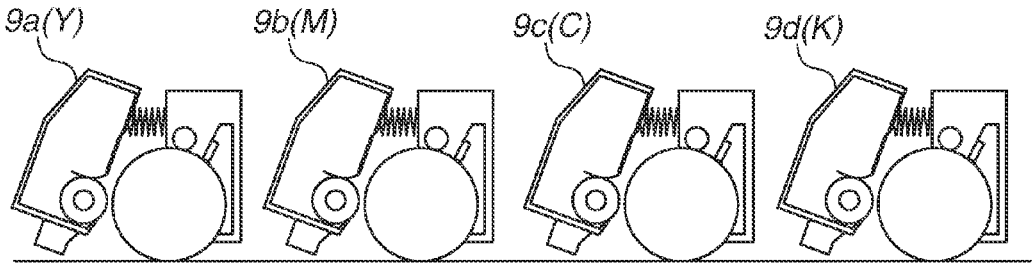
FIGS. 10A, 10B, and 10C are diagrams illustrating changes in contact states when image formation is executed in a KTOP mode.
Figure 10B:
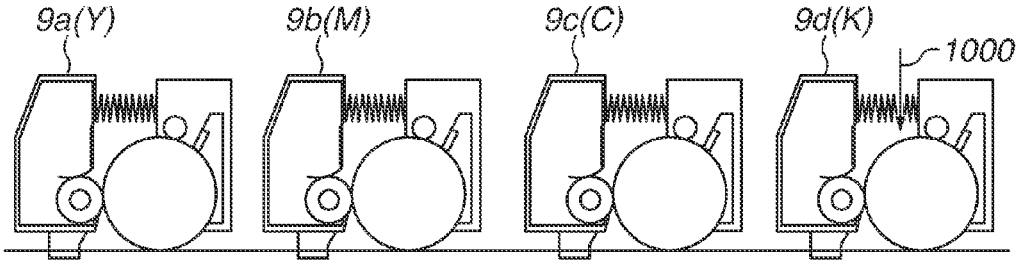
Figure 10C:
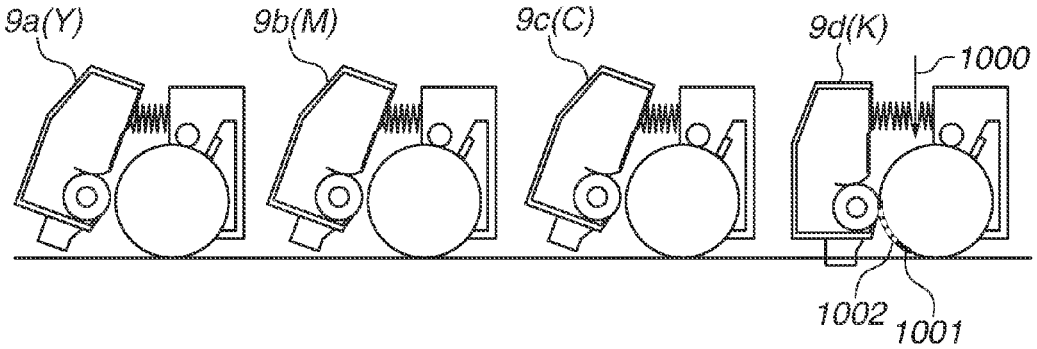

FIGS. 10A to 10C are diagrams illustrating changes in contact states when the image formation is executed in the KTOP mode. FIG. 10A is a diagram illustrating the fully-separated state. When the engine control unit 402 receives a print start command from the controller unit 401, the engine control unit 402 shifts the development contact state to the full-color contact state illustrated in FIG. 10B. The engine control unit 402 transmits a /TOP signal to the controller unit 401 at a timing at which the development contact state has shifted to the full-color contact state. Then, according to the image data received from the controller unit 401, the engine control unit 402 exposes the photosensitive drum 1 of the black station to light 1000 and forms an electrostatic latent image.

The engine control unit 402 transmits the /TOP signal and shifts the development contact state from the full-color contact state to the monochrome contact state illustrated in FIG. 10C. If the development rollers 4 of the stations of yellow, magenta, and cyan are separated from the respective photosensitive drums 1 when the development contact state is shifted to the monochrome contact state, vibration caused by torque fluctuations of motors (not illustrated) is transmitted to the development roller 4 of the black station. Hereinafter, this vibration is also referred to as "separation shock". In a case where vibration caused by the shift of the development contact state to the monochrome contact state is transmitted to the development roller 4 when an electrostatic latent image is being developed by the development roller 4 of the black station, a development blur 1002 occurs in a toner image 1001 that is being developed, so that a non-uniform toner image is obtained. In the present exemplary embodiment, the detailed description will be given below of a method for controlling an image formation timing so as to suppress the degradation in image quality that is caused by the vibration transmitted to the development roller 4 when the above-described image formation is executed. The image formation timing may be preferably set in such a manner that time taken for forming a first image (i.e., first printout time (FPOT)) becomes shorter.

[Description of Control of Image Formation Start Timing]

Figure 11:
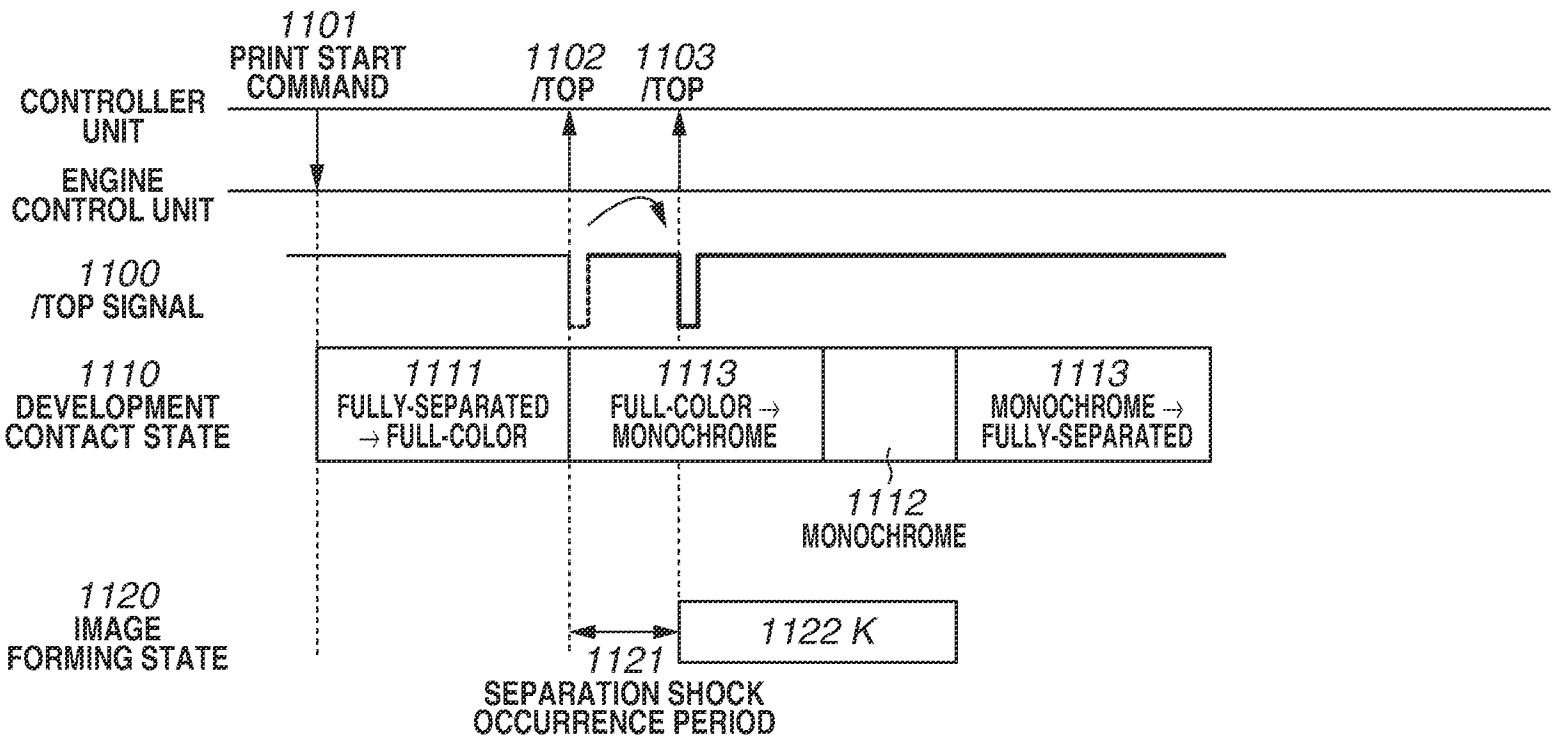
FIG. 11 is a timing chart illustrating control of an image formation start timing according to a second exemplary embodiment.

FIG. 11 is a timing chart illustrating control of an image formation start timing according to the present exemplary embodiment. The engine control unit 402 receives a print start command from the controller unit 401 (1101). Then, in order to form a monochrome image in the monochrome mode, the engine control unit 402 shifts a development contact state from the fully-separated state to the monochrome contact state (1112) via the full-color contact state (1111). The engine control unit 402 calculates a separation shock occurrence period (1121), which is a period between a separation timing at which the full-color contact state is shifted to the monochrome contact state and a timing at which the separation shock is settled.

When the separation shock occurrence period (1121) has elapsed from the separation timing at which the full-color contact state is shifted to the monochrome contact state, the engine control unit 402 transmits a /TOP signal to the controller unit 401 (1103). When the controller unit 401 receives the /TOP signal from the engine control unit 402 (1103), the controller unit 401 starts image formation using the black station (1122), based on the reception of the /TOP signal. When the black image formation is completed, the engine control unit 402 shifts the development contact state from the monochrome contact state (1113) to the fully-separated state (1114), and ends a series of image forming operations.

The transmission of the /TOP signal from the engine control unit 402 to the controller unit 401 is controlled in this manner. In other words, a timing at which an electrostatic latent image is formed on the photosensitive drum 1 is controlled based on the /TOP signal. Further, in other words, a timing at which the development roller 4 develops the electrostatic latent image formed on the photosensitive drum 1 is controlled. By executing the above-described timing control, an image that is being formed can be prevented from being affected by the separation shock.

Figure 12:
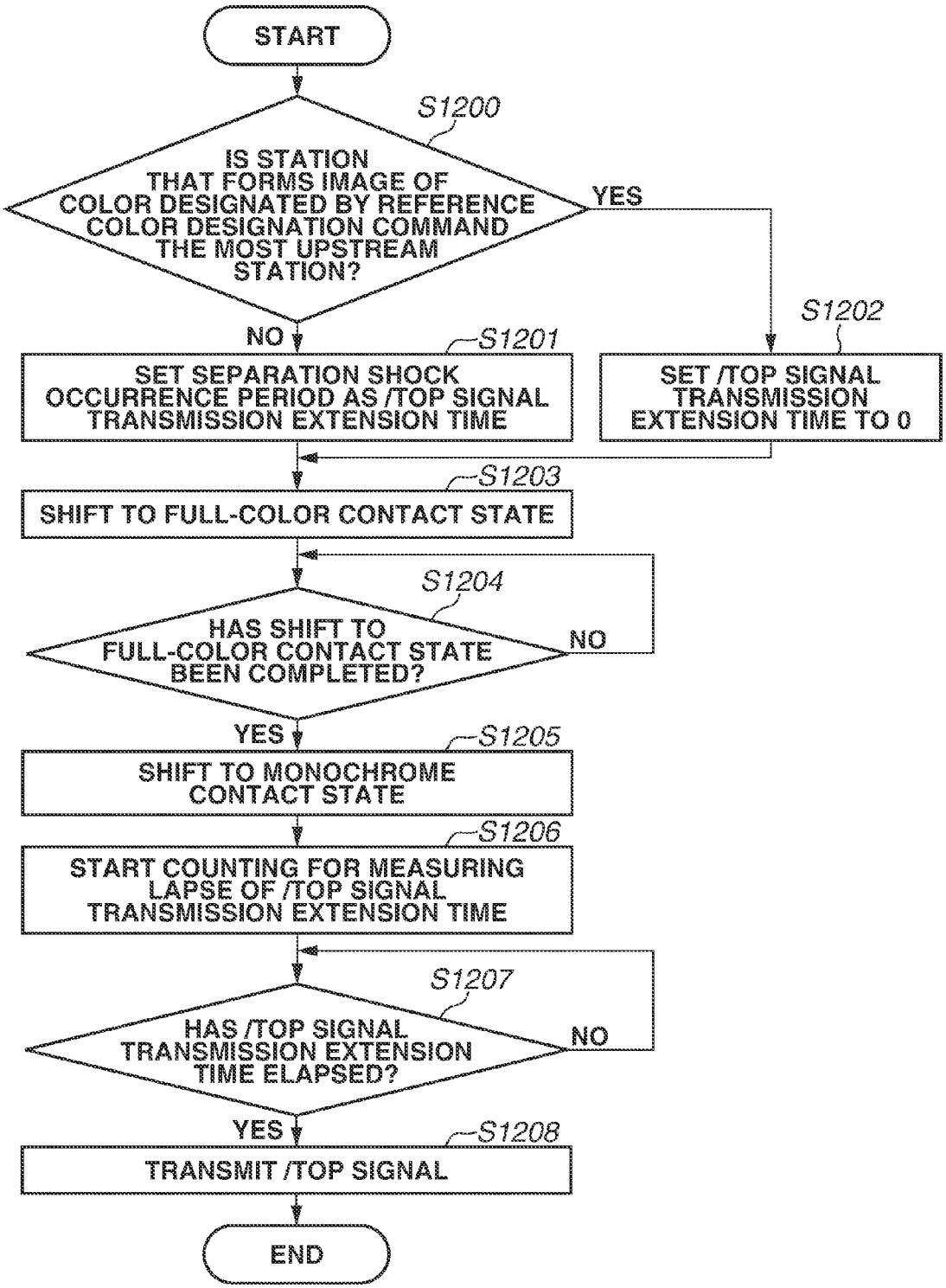
FIG. 12 is a flowchart illustrating control of an image formation start timing according to the second exemplary embodiment.

FIG. 12 is a flowchart illustrating control of an image formation start timing according to the present exemplary embodiment. In step S1200, the engine control unit 402 receives a print instruction from the controller unit 401. Then, the engine control unit 402 determines whether the station that forms an image of a color designated by the /TOP signal reference color designation command transmitted from the controller unit 401 is a station disposed on the most upstream side. In the present exemplary embodiment, the most upstream station is the yellow station. Thus, in other words, the engine control unit 402 determines whether the image formation is executed in the YTOP mode. When it is determined in step S1200 that the station is the most upstream station (YES in step S1200), the processing proceeds to step S1202. In step S1202, the engine control unit 402 sets a /TOP signal transmission extension time to 0. On the other hand, when it is determined in step S1200 that the station is not the most upstream station (NO in step S1200), the processing proceeds to step S1201. In the present exemplary embodiment, the processing in step S1201 and subsequent steps will be described assuming that the most upstream station is the yellow station and the reference color of the /TOP signal is black, as an example.

In step S1201, the engine control unit 402 calculates a separation shock occurrence period, which is a period from the generation to settlement of the separation shock generated when the full-color contact state is shifted to the monochrome contact state, and sets the calculated value as the /TOP signal transmission extension time. In addition, a period until the separation shock is settled does not have to be a period until the vibration is stopped, but may be a period until the vibration is reduced to such an extent that the image formation is not affected. The separation shock occurrence period generated when the full-color contact state is shifted to the monochrome contact state is a value determined according to the configuration of the image forming apparatus, and the value is prestored in the engine control unit 402. For example, if the separation shock occurrence period is 0.4 s, the engine control unit 402 outputs the /TOP signal after 0.4 s has elapsed from a time point at which the development contact state starts shifting from the full-color contact state to the monochrome contact state.

In step S1203, the engine control unit 402 shifts the development contact state to the full-color contact state. In step S1204, the engine control unit 402 determines whether the shift to the full-color contact state has been completed. When the shift to the full-color contact state has been completed (YES in step S1204), the processing proceeds to step S1205. In step S1205, the engine control unit 402 shifts the development contact state from the full-color contact state to the monochrome contact state.

In step S1206, the engine control unit 402 starts counting for measuring the lapse of the /TOP signal transmission extension time calculated in step S1201. In step S1207, the engine control unit 402 determines whether the /TOP signal transmission extension time has elapsed. When the engine control unit 402 determines in step S1207 that the /TOP signal transmission extension time has elapsed (YES in step S1207), the processing proceeds to step S1208. In step S1208, the engine control unit 402 transmits the /TOP signal to the controller unit 401. Thereafter, as described in the first exemplary embodiment, the image formation is started according to the /TOP signal.

By controlling a transmission timing of the /TOP signal in this manner, the development roller 4 forming a toner image can be prevented from being affected by the vibration when the full-color contact state is shifted to the monochrome contact state. Further, in a case where a station other than the most upstream station is designated as a reference color of the /TOP signal, a development shock blur caused by a separation shock occurs when the development roller 4 of the station on the upstream side of the reference color station is separated. By controlling the transmission timing of the /TOP signal, the development shock blur can be prevented from affecting the image formed by the reference color station.

In addition, although the configuration of shifting a contact state through the all-state shift type switching operation has been described as an example in the present exemplary embodiment, a configuration is not limited thereto. Even in a case where the contact state is shifted through the independent shift type switching operation, a problem similar to the above-described problem may occur, and the same effects can be naturally achieved if a transmission timing of the /TOP signal is controlled as described in the present exemplary embodiment. Furthermore, although the description has been given using a black color as an example of the reference color, the reference color is not limited thereto. Any color other than the color of the most upstream station can be designated as a reference color.

Further, in the present exemplary embodiment, a method for suppressing the degradation in image quality caused by the separation shock has been described. Further, in a case where the contact streak is generated in a contact state as described in the first exemplary embodiment, time taken to avoid the contact streak and time taken to settle the separation shock are compared with each other, and the transmission timing of the /TOP signal can be controlled according to the longer time.

Furthermore, in a case where a separation streak caused by a circumferential speed difference between the development roller 4 and the photosensitive drum 1 occurs even in a development separated state described in the first exemplary embodiment, a timing at which the separation streak is not be superimposed on the image is calculated through a method similar to the method described in the first exemplary embodiment. Then, time taken to avoid the separation streak and time taken to settle the separation shock are compared with each other, and the transmission timing of the /TOP signal can be controlled according to the longer time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039422, filed Feb. 27, 2015, which is hereby incorporated by reference herein in its entirety.

What is claimed is:

1. An image forming apparatus comprising:

a plurality of photosensitive drums;

a plurality of development rollers respectively corresponding to the plurality of photosensitive drums, and configured to develop electrostatic latent images formed on the plurality of photosensitive drums as toner images;

an image bearing member onto which the plurality of toner images developed by the plurality of development rollers are transferred;

a shifting mechanism configured to shift between a contact state in which the plurality of photosensitive drums and the plurality of development rollers are in contact with each other and a separated state in which the plurality of photosensitive drums and the plurality of development rollers are separated from each other; and an engine controller configured to control whether to shift the plurality of photosensitive drums and the plurality of development rollers into the contact state or the separated state, wherein the plurality of development rollers includes at least a first development roller and a second development roller, and the plurality of photosensitive drums includes at least a first photosensitive drum corresponding to the first development roller and a second photosensitive drum corresponding to the second development roller, wherein the second photosensitive drum and the second development roller are disposed on an upstream side of the first photosensitive drum and the first development roller in a moving direction of the image bearing member, and wherein, in a case where an electrostatic latent image formed on the first photosensitive drum is to be developed by the first development roller after the engine controller shifts the first development roller and the first photosensitive drum into the contact state and shifts the second development roller and the second photosensitive drum into the contact state, the engine controller controls timing at which the electrostatic latent image formed on the first photosensitive drum is to be developed by the first development roller so that toner to be supplied onto the image bearing member in response to the second photosensitive drum and the second development roller being shifted into the contact state is not superposed on a toner image obtained by developing the electrostatic latent image by the first development roller and transferred onto the image bearing member.

2. The image forming apparatus according to claim 1, wherein the engine controller controls a timing at which the first development roller develops an electrostatic latent image to be equal to or later than a timing at which toner supplied to the image bearing member by the second photosensitive drum and the second development roller shifting to a contact state is not superimposed on a toner image developed from the electrostatic latent image by the first development roller and transferred onto the image bearing member.

3. The image forming apparatus according to claim 1 further comprising an image controller configured to generate image data, wherein the engine controller controls a transmission timing of a request signal for requesting the image data from the image controller, to control a timing at which the first development roller develops an electrostatic latent image as a toner image.

4. The image forming apparatus according to claim 3, wherein the request signal is a signal for requesting the image data from the image controller for forming a toner image on the first photosensitive drum, and is not a signal for requesting the image data from the image controller for forming a toner image on the second photosensitive drum.

5. The image forming apparatus according to claim 3, further comprising an irradiation element configured to form an electrostatic latent image by irradiating a photosensitive drum with light, wherein the engine controller controls a timing at which the irradiation element forms an electrostatic latent image, by controlling a transmission timing of a request signal for requesting the image data from the image controller.

6. The image forming apparatus according to claim 1, wherein the first development roller includes black developer, and the second development roller includes yellow developer, magenta developer, or cyan developer.

7. The image forming apparatus according to claim 1, wherein the engine controller controls a timing at which the first development roller develops an electrostatic latent image, based on the contact timing and a separation timing at which the second development roller and the second photosensitive drum are shifted into a separated state.

8. The image forming apparatus according to claim 7, wherein the engine controller controls a timing at which the first development roller develops an electrostatic latent image to be equal to or later than a timing at which influence of vibration caused by the second photosensitive drum and the second development roller being separated from each other is settled.

9. The image forming apparatus according to claim 7, wherein the engine controller controls a timing at which the first development roller develops an electrostatic latent image to be equal to or later than a timing at which toner supplied to the image bearing member by the second photosensitive drum and the second development roller being separated from each other is not superimposed on a toner image developed from the electrostatic latent image by the first development roller and transferred onto the image bearing member.

10. An image forming apparatus comprising:

a plurality of photosensitive drums;

a plurality of development rollers respectively corresponding to the plurality of photosensitive drums, and configured to develop electrostatic latent images formed on the plurality of photosensitive drums as toner images;

an image bearing member onto which the plurality of toner images developed by the plurality of development rollers are transferred;

a shifting mechanism configured to shift between a contact state in which the plurality of photosensitive drums and the plurality of development rollers are in contact with each other and a separated state in which the plurality of photosensitive drums and the plurality of development rollers are separated from each other; and an engine controller configured to control whether to shift the plurality of photosensitive drums and the plurality of development rollers into the contact state or the separated state, wherein the plurality of development rollers includes at least a first development roller and a second development roller, and the plurality of photosensitive drums includes at least a first photosensitive drum corresponding to the first development roller and a second photosensitive drum corresponding to the second development roller, wherein, after shifting the first development roller and the first photosensitive drum into a contact state and shifting the second development roller and the second photosensitive drum into a contact state, the engine controller controls a timing at which the first development roller develops an electrostatic latent image after a lapse of predetermined time since a start of separation operation of separating the second photosensitive drum and the second development roller from each other from the contact state, and wherein the predetermined time is based on an amount of vibration, the vibration being caused by the second photosensitive drum and the second development roller being separated from each other from the contact state.

11. The image forming apparatus according to claim 10, wherein the second photosensitive drum and the second development roller are disposed on an upstream side of the first photosensitive drum and the first development roller in a moving direction of the image bearing member.

12. The image forming apparatus according to claim 10, wherein the engine controller controls the first development roller to develop an electrostatic latent image, and controls the second engine controller not to develop an electrostatic latent image.

13. The image forming apparatus according to claim 10, wherein the engine controller controls a timing at which the first development roller develops an electrostatic latent image to be equal to or later than a timing at which toner supplied to the image bearing member by the second photosensitive drum and the second development roller being separated from each other is not superimposed on a toner image developed from the electrostatic latent image by the first development roller and transferred onto the image bearing member.

14. The image forming apparatus according to claim 10 further comprising an image controller configured to generate image data, wherein the engine controller controls a transmission timing of a request signal for requesting the image data from the image controller, to control a timing at which the first development roller develops an electrostatic latent image as a toner image.

15. The image forming apparatus according to claim 14, wherein the request signal is a signal for requesting the image data from the image controller for forming a toner image on the first photosensitive drum, and is not a signal for requesting the image data from the image controller for forming a toner image on the second photosensitive drum.

16. The image forming apparatus according to claim 14, further comprising an irradiation element configured to form an electrostatic latent image by irradiating a photosensitive drum with light, wherein the engine controller controls a timing at which the irradiation element forms an electrostatic latent image, by controlling a transmission timing of a request signal for requesting the image data from the image controller.

17. The image forming apparatus according to claim 10, wherein the first development roller includes black developer, and the second development roller includes yellow developer, magenta developer, or cyan developer.

18. The image forming apparatus according to claim 10, wherein the predetermined time is time taken for the vibration to settle.

19. The image forming apparatus according to claim 10, wherein the predetermined time is time taken for the vibration to be reduced to such an extent that development of the electrostatic latent image by the first development roller is not affected.

* * * * *